US005809744A

United States Patent [19]

Villines et al.

[11] Patent Number: 5,809,744

[45] Date of Patent: Sep. 22, 1998

[54] SEMI-BULK VACUUM PACKER FOR FINE LOW BULK DENSITY DRY POWDERS

[75] Inventors: Newton L. Villines, Riceville; William D. Whitner, Etowah; Filip S. Gilmer, Athens, all of Tenn.

[73] Assignee: J.M. Huber Corporation, Edison, N.J.

[21] Appl. No.: 926,989

[22] Filed: Sep. 10, 1997

[51] Int. Cl.[6] ..... B65D 1/26; B65D 31/00

[52] U.S. Cl. ..... 53/434; 53/436; 53/469; 53/512; 53/527; 53/255; 141/59; 141/65; 141/314

[58] Field of Search ..... 53/432, 434, 436, 53/469, 510, 512, 527, 255; 100/90; 141/59, 65, 313, 314, 315, 316, 317

[56] References Cited

U.S. PATENT DOCUMENTS

| | | | |
|---|---|---|---|
| 2,806,771 | 9/1957 | Cuthertson | 100/90 |
| 2,815,621 | 12/1957 | Carter | 53/527 X |
| 3,218,778 | 11/1965 | Moreland | 53/527 |
| 3,377,945 | 4/1968 | Davis | 100/90 |
| 3,468,095 | 9/1969 | Vogt | 53/527 X |
| 3,847,191 | 11/1974 | Aronson | 53/527 X |
| 4,457,125 | 7/1984 | Fishburne | 53/527 |
| 5,339,871 | 8/1994 | Collins et al. | 141/59 X |
| 5,447,183 | 9/1995 | Derby | 141/59 X |
| 5,474,111 | 12/1995 | Williamson et al. | 141/314 X |

OTHER PUBLICATIONS

Advertisement, "Automated Packaging Systems and Conveyors Co.", Jan. 30, 1991.

Advertisement, "Dry solids Densifiers", 1992, Carman Industries.

Advertisement, "Feeding Vacuum Conveyors", Semi–Bulk Systems Inc.

*Primary Examiner*—Linda Johnson

*Attorney, Agent, or Firm*—Whitham, Curtis & Whitham

[57] ABSTRACT

A vacuum shell (10) defines an inner cavity (18) in which particulate materials are packed via vacuum pressure. In use, the vacuum shell (10) is positioned within the container (such as sack (16)), and the open end 15 of the shell 10 is brought into contact with a surface (such as platform (17 or 17')) such that a vacuum tight compartment is created. Particulate material is supplied through port (26 or 27) into the inner cavity (18) while vacuum pressure is applied. The particulate material is densified within the inner cavity (18) under the vacuum pressure, and when the volume/quantity of particulate is achieved, the vacuum pressure ceases, and the vacuum shell (10) is withdrawn from the container. To enhance filling, the filter media inside the vacuum shell (10) can be periodically pulsed with air or other suitable gases to remove particulate cakes from the filter material (22).

19 Claims, 1 Drawing Sheet

SEMI-BULK VACUUM PACKER FOR FINE LOW BULK DENSITY DRY POWDERS

BACKGROUND OF THE INVENTION

1. Field of the Invention

The invention is generally related to a vacuum packing apparatus and method which allows fine particulate matter to be packed, in high density, in large packing sacks.

2. Background Description

Vacuum packing is used in a wide variety of industries to package particulate and non-particulate materials. Vacuum packing protects the product from oxidation during shipping and storage. In addition, vacuum packing helps minimize the total volume occupied by the packaged product and storage container, thus allowing more units of product to be stored in a selected volume.

Packaging products comprised of small particles presents several technical problems, particularly where large quantities of the small particles are desired. For exemplary purposes only, precipitated silica is an example of a small particle product that is used in a variety of industrial applications. For example, it is an additive which is used in the manufacture of toothpaste, it has applications as a de-foamer in food and non-food applications, it is used in paper manufacturing, as well as in a variety of other applications. Precipitated silica particles are typically on the order of 1–10 microns in size. Thus, these particles cannot simply be poured into a storage sack or container since they have a very low weight and would tend to aerosolize in the ambient air. Applying vacuum pressure to the particles during packing can enable these small particles to amass in a packaging bag. However, simply pulling a vacuum through a paper bag, as is done for example in packaging coffee, is not satisfactory. Specifically, in order to obtain a dense product using prior art vacuum packing strategies, the size of the bags would need to be limited to 25 lbs. This would present complex handling and shipping problems since multiple bags would be required for a particular application.

Furthermore, if a large sack were used instead of a small bag, and vacuum suction were only pulled through the bottom of the sack so as to allow larger quantities of product to accumulate in the sack, then a density gradient for the product in the sack would result where the product would be more dense at the bottom of the sack and less dense at the top. This density gradient would be a function of the vacuum pressure being exerted at progressively lower levels as more product is installed in the bag due to both having to exert vacuum pressure through previously packed materials and having to exert vacuum pressure at a greater distance from the bottom of the sack. As a result, the packed product would occupy more space than desired, and would make stacking of packed sacks more difficult, both problems being due to the lower density packing of product at the top of the sacks.

SUMMARY OF THE INVENTION

According to the invention, a vacuum sack packing apparatus includes a vacuum shell which fits within a sack, bag or other suitable container. The vacuum shell can be formed in any desired shape (e.g., cylinder, cube, rectangular block, etc.) and is selected to define the shape and volume of the finished product packaging. A filter media is positioned on the inner surfaces of the vacuum shell. In the preferred embodiment, the filter media is comprised of a plastic grid with a filter material liner positioned over the grid and it operates by having vacuum pressure exerted through the filter material liner. The grid serves to space the filter material liner from the walls of the vacuum shell and to distribute suction pressure evenly inside the vacuum shell.

In the case of large sack packing, such as with a super sack having dimensions in excess of 40×40×50 cubic inches (most preferably 42×42×55 cubic inches), it is preferred that the vacuum shell be used in combination with a platform which also applies vacuum pressure. The platform could be comprised of the same or different filter media used in the vacuum shell, and could be connected to the same or a different vacuum source as the vacuum shell. In addition, the vacuum pressure exerted by the platform and the vacuum shell could be independently or simultaneously controlled, and could exert the same or a different pressure. The platform is used to maintain the bottom of the sack flat during filling and to apply additional vacuum pressure for filling and densifying particulate product in the sack. Ideally, the vacuum shell would rest on the platform during vacuum filling such that a uniform vacuum pressure would be exerted with a space defined by the platform under the base of sack and the filter media on the inside surfaces of the vacuum shell.

In operation, the vacuum shell is positioned within the container to be filled. The material to be packaged, which for example can be small particle powders such as precipitated silicas, is ported into the vacuum shell under vacuum pressure. The particles would adhere firmly to the filter media of the vacuum shell during filling of the container, and, in the case of sack filling, to the base of the sack via the vacuum pressure applied by the platform. The vacuum pressure allows the particulates to be densely packed within the volume defined by the vacuum shell. Periodically, air or other suitable gases (e.g., nitrogen), can be pulsed into the shell to clean the filter medium. Thereafter, the vacuum pressure can begin again to densify particles within the container and to further fill the container with additional particulate matter. After a desired volume and density of particulate product is installed within the vacuum shell, the vacuum shell is withdrawn from the container, and the container is closed or otherwise sealed.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 2:
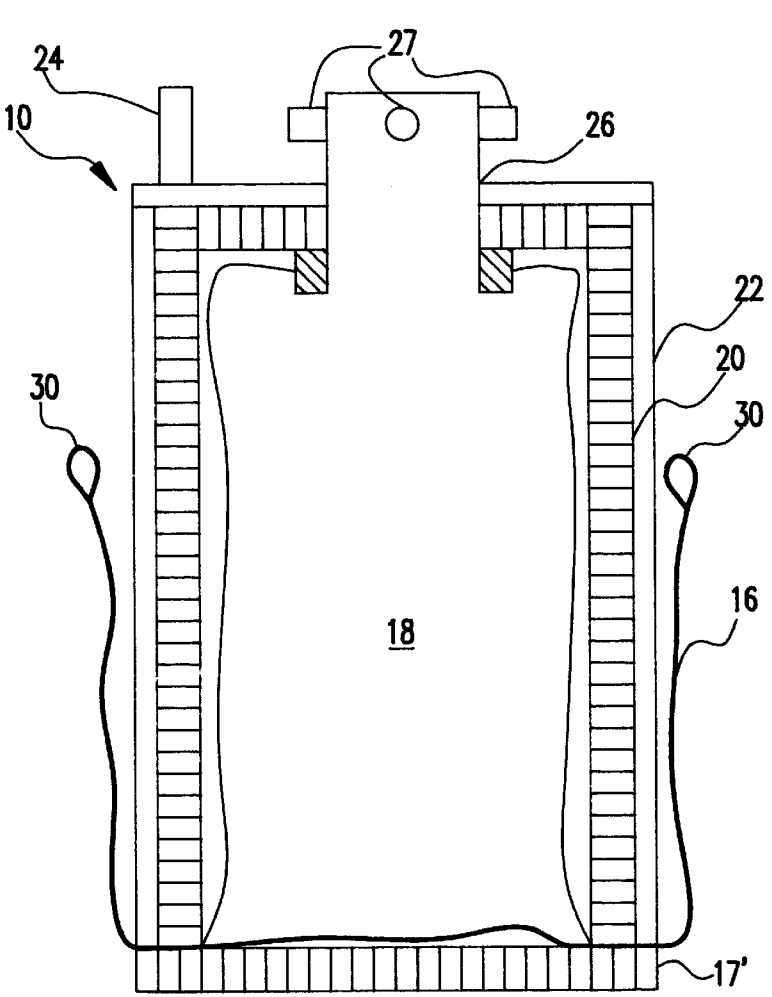
FIG. 2 is a schematic, cut-away side view of another embodiment of the invention.
Figure 1:
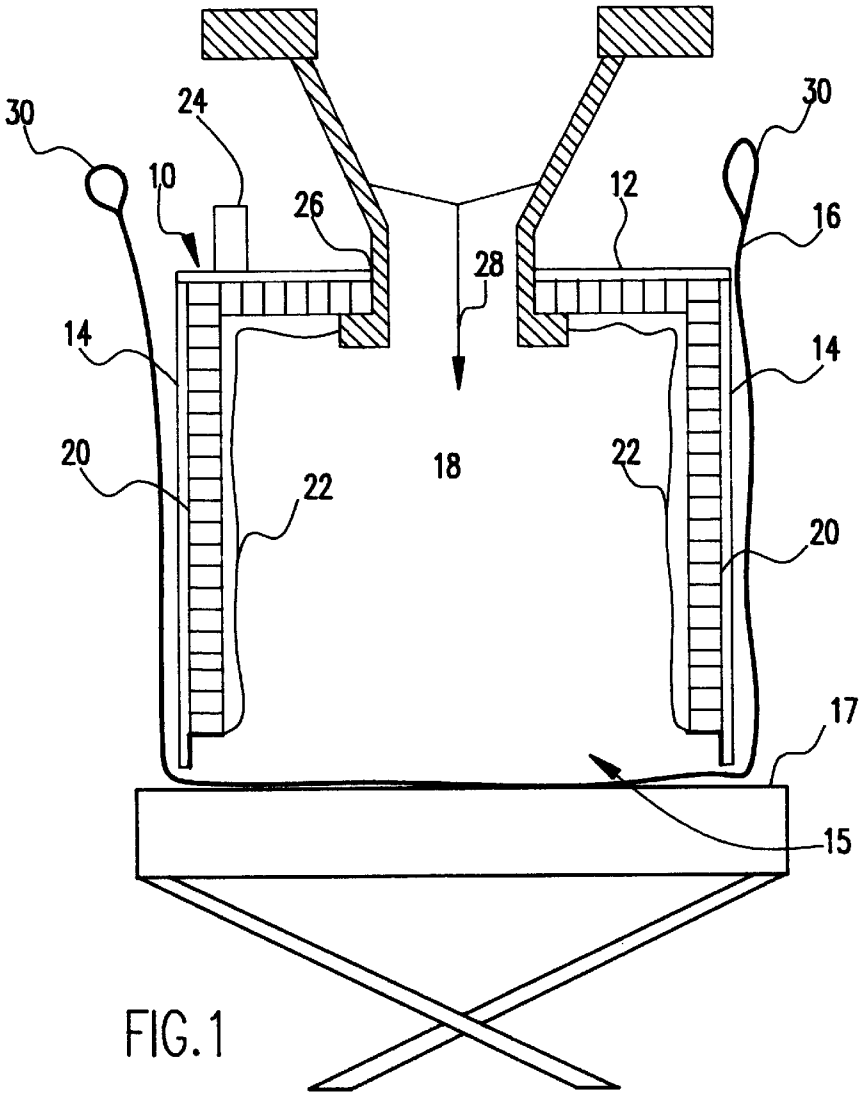
FIG. 1 is a schematic, cut-away side view of one embodiment of the invention.

FIGS. 1 and 2 show alternative embodiments of this invention, and are examples of the type of vacuum packing apparatus contemplated by the claims. Those of ordinary skill in the art will recognize that alternative configurations for the components described in conjunction with FIGS. 1 and 2 could be implemented within the spirit and scope of the appended claims. In addition, for exemplary purposes only, the invention is described in conjunction with packing precipitated silica powder in large-sized super sacks; however, it will be noted by those of skill in the art that the methods and apparatus can be employed with a wide variety of products to allow vacuum packing within a wide variety of different containers. Like numerals in FIGS. 1 and 2 denote like elements.

FIGS. 1 and 2 show a vacuum shell 10 having a top 12 and side walls 14 fitted within a sack 16. Containers such as boxes, cartons, bags, cylindrical vessels, etc., could be used within the practice of this invention instead of the sack 16. A sack 16 has been selected to illustrate the use of this invention in packing large quantities of dry powder materials, such as 1–10 micron sized precipitated silica, within a large sack (e.g., a super sack having dimensions of 42×42×55 cubic inches). Indeed, experiments have shown the ability to pack over 400 lbs of precipitated silica within such a sack using the invention described herein, and this is a significantly greater quantity than has been achieved with prior art vacuum packing systems that do not employ a vacuum shell 10.

The vacuum shell 10 can be fabricated from steel, aluminum, or other suitable materials, and should be of sufficient strength and integrity to withstand vacuum forces exerted within an inner cavity 18 defined by the side walls 14 and open end 15 when the open end is positioned on platform 17, or is otherwise in contact with an inside surface of the sack 16. The vacuum shell 10 is preferably configured in the shape of the desired finished product packaging. That is, the inner cavity 18 of the shell 10 can be in the shape of a cylinder, rectangular block, cube, or the like, as the packaging requirements require.

The vacuum shell 10 includes a filter media on its inside surface which, in the preferred embodiment, includes a grid 20 and a filter material 22. The grid 20 spaces the filter material 22 away from the sidewalls 14 of the shell 10, and allows vacuum pressure exerted by a vacuum source connected at port 24 to be evenly distributed throughout the inner cavity 18. The grid 20 can be made of plastics, metals, or other suitable materials, and, in the preferred embodiment, can have multiple passages on the order of ¼" to ½" in diameter. The filter material 22 is designed to withdraw air from the inner cavity 18, but to leave particulate material within the inner cavity. Thus, the filter material 22 must be chosen such that the pores therein are smaller than the particles intended to be filled in the sack 16. In filling sacks with precipitated silica, it is expected that the filter material 22 should have a pore diameter small enough to retain the silica in the cavity 18. Suitable materials which might be used as the filter material 22 include polytetrafluoroethylene coated polyester and other treated polyesters.

Particulate material will be deposited into the cavity 18 defined by the vacuum shell 10 via a port 26 which extends through the vacuum shell 10. The port 26 can take the form of a gravitation hopper feed as shown in FIG. 1, or a plurality of feed conduits 27, as shown in FIG. 2. The plurality of feed conduits 27 can be used as a means for depositing particulate material from the same source into the same sack via different conduits, or from different sources into the same sack. In some applications, different particulate materials can be mixed together in the same sack by controlling access through selected ports 27 from different sources of particles. Vacuum pressure exerted through the filter media on the inner surfaces of the vacuum shell 10 draws the particulate material into the inner cavity 18, as indicated by arrow 28. In filling sacks 16 with light weight, small particulates such as precipitated silica, it is expected that vacuum pressures within the range of 15" to 20" Hg will be satisfactory to fill the inner cavity 18, and densify the precipitated silica therein. The particulate material (not shown) coats the inner walls of the vacuum shell 10 during filling. To aid in vacuum packing, the vacuum pressure inside the vacuum shell 10 can be periodically turned off and the filter media can be pulsed with a gas such as air or nitrogen. This knocks particulate material caked onto the filter 22 off and into the center and bottom of the cavity 18. After the pulse, the vacuum pressure is reinstated to allow further filling of the sack 16 inside of the inner cavity 18, and densification of the particulate material therein.

Measurements can be made to determine the volume and density of product within the inner cavity 18. For example, volume can be determined by monitoring the level of particulate within the inner cavity 18, and density can be determined from a volume measurement and a measurement of the amount of particulate material which has been deposited through the conduit 26. Alternatively, density can be computed from the volume measurement and a weight measurement taken at platform 17. FIG. 2 emphasizes that the vacuum shell 10 need not be smaller than sack 16 being filled. Rather, all that is required is that the operator have some mechanism for determining when to stop filling the sack 16.

Once a sack 16 has a sufficient quantity of particulate material therein, as may be determined by volume and/or density measurements, or by other means such as simple visual inspection, the vacuum pressure is ceased, and the vacuum shell 10 is withdrawn from the sack 16. The sack 16 is then closed by securing the top members 30 together. This can be accomplished using a drawstring, by heat sealing, by gluing, by stapling, and by or other suitable means. Because the particulate material is densely packed in the inner cavity space 18, the final product assumes a shape molded by the contours of the vacuum shell 10. Hence, the particulate product can be molded into a large, stackable configuration to allow easier transport and handling. If desired, air positioned in the region once occupied by the vacuum shell prior to withdrawal from the sack 16 can be withdrawn prior to or after closure of the sack using conventional vacuum pressure techniques (e.g., drawing a vacuum against the sack 16 after closure of top members 30).

A particular advantage of the present invention is that the sack 16 can be made from a non-porous material such as plastic (e.g., polyethylene coated materials). Traditionally in vacuum packing operations, the storage sack itself is porous. However with the present invention, materials, such as precipitated silica, can be vacuum packed and sealed in a non-porous sack which will provide moisture resistance, etc., that will enable the integrity of the product to be maintained during shipping.

FIG. 1 illustrates one configuration for positioning the vacuum shell 10 on the platform 17. In particular, the sack 16 is positioned on the platform 17 and pulled up around the vacuum shell. A pair of scissor legs 32 raises the platform 17 and sack 16 up to vacuum shell such that the vacuum shell rests on the platform 17 and makes a vacuum seal therewith, thus allowing vacuum pressure exerted through filter 22 to tightly pack and densify particulate product drawn 28 down through port 26 into the inner cavity 18. It will be apparent to those of skill in the art that there are other equivalent mechanisms for positioning the vacuum shell 10 in the sack 16 and bringing the shell 10 into contact with platform 17.

The platform 10 can be made from a soft, rubber material to assist in the formation of a vacuum tight inner cavity. Alternatively, and as is best shown in FIG. 2, the platform 17' could include a vacuum pressure applying mechanism similar to that used within the inner cavity 18. For example, the platform 17' could include a filter media comprised of a grid and filter material similar to that used on the inner surfaces of the vacuum shell 10. An advantage of this configuration is that the platform 17' would hold the bottom of the sack 16 flat such that a vacuum tight seal between the platform 17' and vacuum shell 10 could be more easily be achieved. If desired, the same source of vacuum pressure (e.g., a pump or the like), could be connected to both the shell 10 and platform 17' such that vacuum pressure can be uniformly controlled within cavity 18. However, in some applications, separate control of vacuum pressure for the platform 17' and shell 10 may be desired.

While the invention has been described in terms of its preferred embodiments, those skilled in the art will recognize that the invention can be practiced with modification within the spirit and scope of the appended claims.

We claim:

1. A vacuum packing apparatus, comprising:

a shell defining an inner cavity volume and an open end;

an air permeable filter material which prevents micron sized particles from passing therethrough positioned within said inner cavity volume of said shell;

a spacer positioned between said shell and said filter material in said inner cavity volume of said shell and spaced away from said shell by a distance suitable to allow air flow between said spacer and said shell, said spacer having multiple passages therethrough which allow vacuum pressure to be exerted through said air permeable filter material;

a vacuum source connected to said shell to exert vacuum pressure through said filter material and said spacer; and a port traversing through said shell which allows product from a product source to pass into said inner cavity volume defined by said shell.

2. The vacuum packing apparatus of claim 1 wherein said shell has at least one sidewall and a closed end, said sidewall and said closed end being connected.

3. The vacuum packing apparatus of claim 2 wherein said shell is in the shape of a cylinder.

4. The vacuum packing apparatus of claim 2 wherein said shell is in the shape of a rectangular box.

5. The vacuum packing apparatus of claim 2 wherein said shell is in the shape of a cube.

6. The vacuum packing apparatus of claim 1 wherein said spacer comprises a grid.

7. The vacuum packing apparatus of claim 1 wherein said filter material is comprised of polyester.

8. The vacuum packing apparatus of claim 1 wherein said vacuum source is a pump.

9. The vacuum packing apparatus of claim 1 wherein said vacuum source applies a vacuum pressure ranging between 15" and 20" Hg.

10. The vacuum packing apparatus of claim 1 further comprising a platform, said open end of said shell being selectively positionable on said platform to create an enclosed cavity defined by said shell and said platform.

11. The vacuum packing apparatus of claim 10 further comprising a second filter material on said platform and a second vacuum source connected to said platform for exerting vacuum pressure through said second filter material.

12. The vacuum packing apparatus of claim 11 wherein said air permeable filter material and said second filter material are the same.

13. The vacuum packing apparatus of claim 11 wherein said vacuum source and said second vacuum source are connected to a common source of vacuum pressure.

14. A method of packing particulate materials in a container, comprising the steps of:

positioning a vacuum shell within a container to be filled, said vacuum shell defining an inner cavity volume and having an open end, said open end contacting an inner surface of said container;

exerting a vacuum pressure within said inner cavity volume through an air permeable filter material which prevents micron sized particles from passing therethrough and a spacer which are both positioned within said inner cavity volume of said shell, said spacer being positioned between said shell and said filter material in said inner cavity volume of said shell and spaced away from said shell by a distance suitable to allow air flow between said spacer and said shell, said spacer having multiple passages therethrough which allow vacuum pressure to be exerted through said air permeable filter material;

filling said inner cavity volume with a particulate material which is transported into said inner cavity volume defined by said shell through a port in said vacuum shell, said steps of filling and exerting occurring simultaneously; and withdrawing said vacuum shell from said container after a volume of particulate material is positioned within said container.

15. The method of claim 14 further comprising the step of periodically pulsing said filter material with a gas to discharge particulate material from said filter material.

16. The method of claim 14 wherein said container is selected to be a sack, and further comprising the step of closing said sack after said step of withdrawing.

17. The method of claim 14 further comprising the steps of determining a volume of particulate material within said container prior to said step of withdrawing, and determining whether said volume is equivalent to a selected volume to be deposited in said container.

18. The method of claim 14 further comprising the step of determining a density of said volume of particulate material within said container prior to said step of withdrawing.

19. The method of claim 16 wherein said sack is comprised of a non-porous material.

* * * * *